US005484159A

United States Patent [19]

Dean et al.

[11] Patent Number: 5,484,159

[45] Date of Patent: Jan. 16, 1996

[54] COVERED FLYING OBJECT

[75] Inventors: Lance L. Dean, 808 Mayfair Hill Ct., Bedford, Tex. 76021; Gust C. Kepler, Dallas, Tex.

[73] Assignee: Lance L. Dean, Bedford, Tex.

[21] Appl. No.: 280,375

[22] Filed: Jul. 26, 1994

[51] Int. Cl.[6] ..... A63H 33/18

[52] U.S. Cl. ..... 273/424; 446/46

[58] Field of Search ..... 273/424, 425, 273/426, 427, 428; 446/46, 47, 48

[56] References Cited

U.S. PATENT DOCUMENTS 3,359,678 12/1967 Headrick ..... 273/424 X 4,222,573 9/1980 Adler ..... 273/426

4,288,942 9/1981 Nicholl ..... 273/424 X 4,979,922 12/1990 Clark ..... 273/424 X

*Primary Examiner*—William H. Grieb

*Attorney, Agent, or Firm*—Max Ciccarelli; James E. Bradley

[57] ABSTRACT

A substantially flat, rigid flying object adapted for throwing. The object has a peripheral portion for gripping the object with a hand and launching the object through the air. The object also has an upper surface and a lower surface aerodynamically shaped to cause the object to fly when thrown. A layer of resilient material covers the upper surface and lower surface. The resilient material has a greater resiliency than the object to provide a cushioned grip.

20 Claims, 2 Drawing Sheets

COVERED FLYING OBJECT

BACKGROUND OF THE INVENTION

1. Field of the Invention

This invention relates in general to flying objects and in particular to substantially flat rigid flying objects adapted for throwing by gripping a peripheral portion thereof with a hand and launching the object through the air.

2. Description of the Prior Art

Many flying objects are available that are designed to be thrown by gripping a periphery thereof with a hand and launching the object through the air. Often, such objects are thrown by one person to another person who attempts to catch the object. Other objects are designed for throwing by one person and for catching by the same person. The throwing and catching of such objects is primarily performed for entertainment, but competitive activities have become more popular.

Some such objects are launched by thrusting the object forwards while imparting spin thereon. The objects are aerodynamically shaped so that their speed through the air, combined with the imparted spin, help the objects to fly better and further.

There is a wide variety of such objects. Two of the more popular types include discs and boomerangs. These objects are typically made of rigid materials. Discs are often made of relatively hard plastics, and boomerangs are often made of either wood or plastic.

The discs, boomerangs, and other such objects currently available suffer from several drawbacks. One such drawback is the hardness of the objects. Since these objects are made of relatively hard materials, prolonged use often causes injury to the user. If the objects are thrown at high speed, even one imperfect catch can cause injury to the catcher's hand. Improper catches, however, are not the only source of injury. Even proper catches eventually injure the catcher's hand. Because of the spin and forward velocity of the object, as the catcher catches the object, the hand acts as a brake. Repeated catching of such hard objects can be painful to the catcher's hand. For example, the hands of persons that engage in competitive activity with such objects are often full of cuts and damaged skin.

Also, because these objects are made of relatively rigid and hard materials, gripping the object under certain circumstances is sometimes difficult. For example, a wet or sweaty hand can make the grip on such objects slippery, thus making it harder to throw and catch.

Another drawback of the currently available objects of this type is that they generally do not float. Depending on the type of material used and the shape of the object, some of the currently available objects float, but since they have a very low center of buoyancy, they float with a majority of the object submerged. However, the majority of the objects of this type do not float. Since these objects are often used around or near water, such as at the beach and around swimming pools, their failure to float is a serious inconvenience.

Still further, the popularity of such objects is so great that it is desirable to manufacture very low cost versions of these objects. One of the best ways to reduce the cost of manufacture is to use less material and to use cheaper material. However, by using less and cheaper material, the weight of the object is drastically reduced. The reduced weight translates into worse flight characteristics. Because of the reduced weight, the objects lose stability. The loss of stability makes it harder to correctly throw the object.

One advantage of making the object lighter is that it causes less injury when properly caught. However, as discussed above, this is at the expense of good flight characteristics. Since the lighter object is harder to throw, it is more often misthrown, thus increasing the likelihood of injury during catching.

Thus the need exists for a flying object such as a disc or boomerang that reduces the chance of injury to the user, that is easy to grip, that floats, and that is heavy enough to produce acceptable flight characteristics.

SUMMARY OF THE INVENTION

It is the general object of the invention to provide an improved flying object that reduces the chance of injury to the user, that is easy to grip, that floats, and that is heavy enough to produce acceptable flight characteristics.

The object of the present invention is a substantially flat, rigid flying object adapted for throwing. The object has a peripheral portion for gripping the object with a hand and launching the object through the air. The object also has an upper surface and a lower surface aerodynamically shaped to cause the object to fly when thrown. A layer of resilient material covers at least part of the upper surface and at least part of the lower surface. The resilient material has a greater resiliency than the object to provide a cushioned grip.

The above as well as additional objects, features, and advantages will become apparent in the following description.

DETAILED DESCRIPTION OF THE INVENTION

Figure 1:
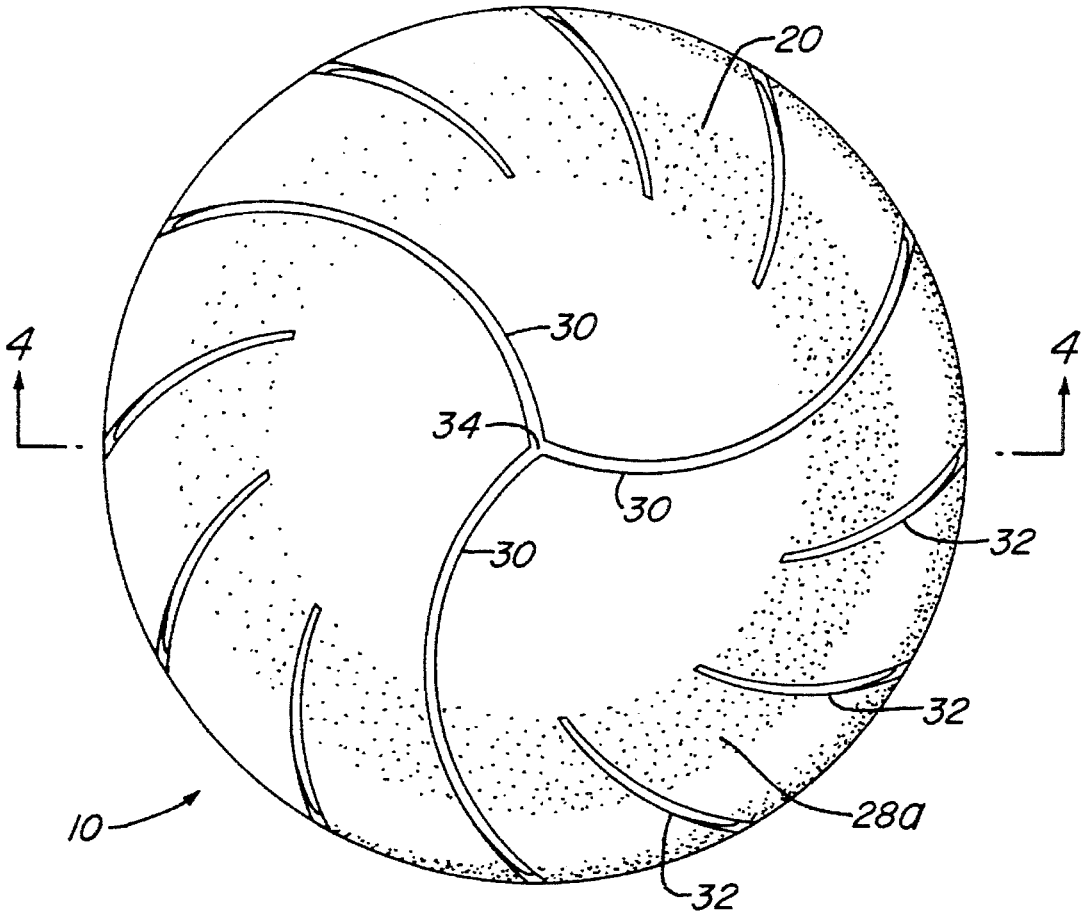
FIG. 1 is a top view of an apparatus according to the present invention.
Figure 2:
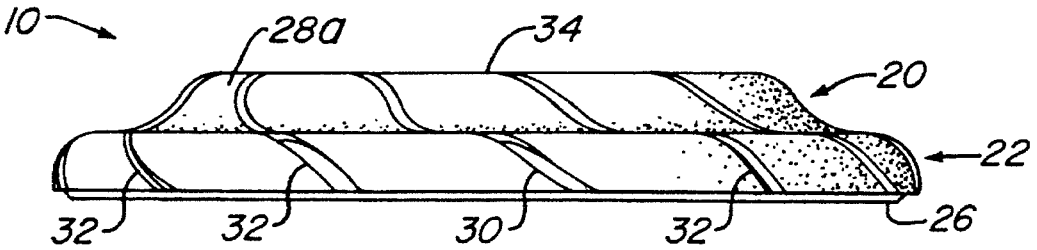
FIG. 2 is a front view of the apparatus of FIG. 1.
Figure 3:
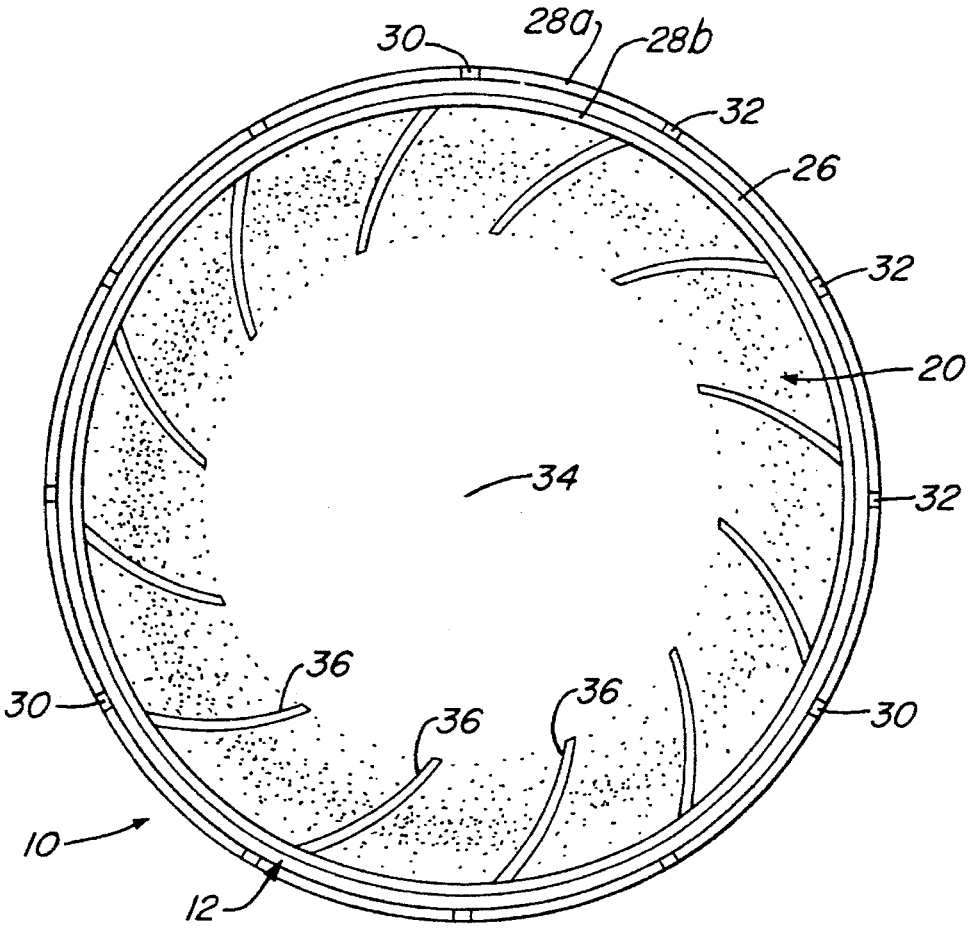
FIG. 3 is a bottom view of the apparatus of FIG. 1.
Figure 4:
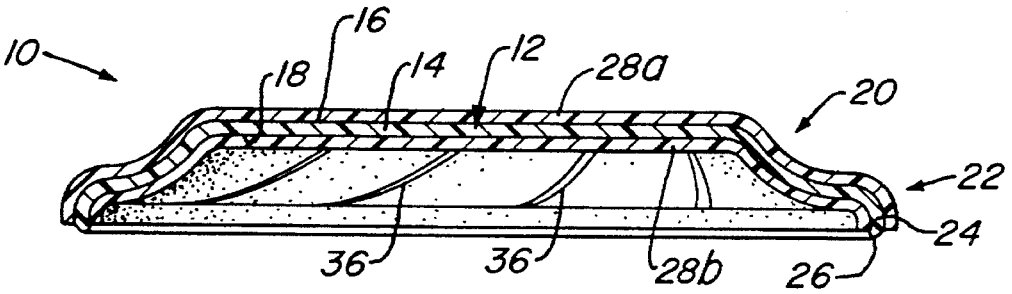
FIG. 4 is a vertical cross sectional view of the apparatus taken along line 4—4 of FIG. 1.

FIGS. 1, 2, and 3 show a top view, front view, and bottom view, respectively, of the covered flying object 10 of the present invention. Although the flying object can take on various shapes and forms, it is shown in this preferred embodiment as a disc. FIG. 4 shows a vertical cross section of covered disc 10 taken along line 4—4 of FIG. 1. With reference to FIG. 4, a plastic disc 12 is shown. Plastic disc 12 has a body 14 having an upper surface 16 and a lower surface 18. Body 14 is flat at its center and curves downward at its periphery 20. Periphery 20 of body 14 terminates at a rim 22. Rim 22 is integrally attached at its upper edge to peripheral portion 20 of body 14, and extends downward below lower surface 18. Rim 22 has a sidewall 24 and a lower edge 26.

The downward extending peripheral portion 20 of body 14, together with rim 22, give the disc a concave shape which is aerodynamically designed to allow the plastic disc to fly when thrown, as further described below.

Layers 28*a* and 28*b* of resilient material are attached to upper and lower surfaces 16 and 18 of plastic disc 12. Layer 28*a* of resilient material is located along upper surface 16, and layer 28*b* of resilient material is located along lower surface 18. Layer 28*a* extends over upper surface 16 and over the outer portion of sidewall 24 of rim 22. Layer 28*b* extends over lower surface 18 and over the inner portion of sidewall 24 of rim 22. The lower edge 26 of rim 22 is not covered by resilient material for the reasons explained in more detail herein.

Referring now to FIGS. 1 and 2, formed into layer 28*a* of resilient material located on upper surface 16 of disc 10 are long grooves 30 and short grooves 32. Three long grooves 30 are angularly spaced around upper surface 16, each separated by an angle of about 120 degrees. Each long groove 30 begins at center 34 of disc 10 and extends helically outward toward periphery 20 of disc 10, and then helically downward along sidewall 24 of rim 22. The spiral formed by long grooves 30 is a counter-clockwise spiral as seen from the top of disc 10.

Located at the periphery 20 of upper surface 16 of disc 10 are short grooves 32. Three short grooves 32 are evenly spaced between each pair of long grooves 30. Each short groove 32 begins at a point about two-thirds the distance between center 34 and rim 22, and extends helically outward toward rim 22, and helically downward along sidewall 24 of rim 22. The spiral formed by short grooves 32 is a counter-clockwise spiral as seen from the top of disc 10. The beginning points of each short groove 32 define a circle located between half the distance and two-thirds the distance between center 34 and rim 22 of disc 10.

Referring now to FIG. 3, formed into layer 28*b* of resilient material located on lower surface 18 of disc 10 are grooves 36. Grooves 36 are evenly spaced around the periphery of disc 10. Each groove 36 begins at a point about two-thirds the distance between center 34 and rim 22, and extends helically outward toward rim 22, and helically downward along sidewall 24 of rim 22. The spiral formed by grooves 36 is a clockwise spiral as seen from the bottom of disc 10. The beginning points of each short groove 36 define a circle located between half the distance and two-thirds the distance between center 34 and rim 22.

The orientation described above of grooves 30, 32, and 36 located in layers 28*a* and 28*b* of resilient material is designed to facilitate the placement of layers 28*a* and 28*b* of resilient material over plastic disc 12. Because of the curvature of plastic disc 12, a flat sheet of resilient material would not properly form over the contours of plastic disc 12. The grooves formed in the resilient material prior to placement of the resilient material over plastic disc 12 allows the layers 28*a* and 28*b* of resilient material to properly form around the contours of plastic disc 12. Grooves 30, 32, and 36 also help the aerodynamics of disc 10 as further described below.

The resilient material of layers 28*a* and 28*b* can be selected from a wide variety of materials having appropriate properties. The key property is resiliency, that is, the material must be relatively easy to compress so as to absorb shock and must be capable of recovering its shape after being compressed. Also, the material must be capable of being applied in a layer over the plastic disc 12. Furthermore, the material must be soft to the touch so as to provide a comfortable grip. Still further, the material must have a sufficiently low density to cause disc 10 to float, as further explained herein. Closed cell rubbers, such as neoprene, and some expanded plastics, are particularly suitable for the resilient material of this invention.

Two types of neoprene sheets which have been successfully used for this invention are of the neoprene type EPT/SBR sold by Rubatex Corporation as stock numbers R-421-N and R-426-N. These two types of neoprene have a density of about 80–190 kg/m$^3$ and a compression deflection of about 0.14–0.35 kg/cm$^2$.

These particular materials are sold in sheets which can be easily cut to size. Sheets having a thickness of about 1/16 inch to about ¼ inch have been found particularly suitable, with the exact thickness being determined by the desired final weight of disc 10. Layers 28*a* and 28*b* of resilient material are attached to plastic disc 12 by conventional adhesives. The type of adhesive used depends on the material of plastic disc 12 and on the resilient material.

In operation, the covered disc 10 of the present invention functions as follows. The user grips periphery 20 of disc 10 with his or her hand. The layers 28*a* and 28*b* of resilient material provide a cushioned grip which facilitates gripping disc 10. The user than launches disc 10 through the air by thrusting the hand forward while flipping his or her wrist to impart spin on disc 10. At the appropriate time, the user releases disc 10 which initiates its flight through the air. If the user launches disc 10 in a conventional fashion with his or her right hand, a clockwise spin will be imparted on disc 10, as seen from the top. The forward velocity of disc 10, the shape of disc 10, and the spin imparted on disc 10 are believed to help the flight characteristics by making disc 10 fly longer distances in a stable flight pattern.

The spiral grooves 30, 32, and 36 are believed to appropriately alter the airflow over and under disc 10 so as to improve the flight characteristics of disc 10. The altered air flow reduces friction between the air and disc 10 and also stabilizes disc 10. If the user desires to throw disc 10 with a counter-clockwise spin, the direction of the spiral grooves 30, 32, and 36 should be reversed in order to obtain optimal advantages therefrom.

One of the factors that greatly affects the flight of disc 10 is the weight of disc If disc 10 is too light, any imperfections in the throwing motion will be greatly felt by disc 10, thus resulting in a wobbly flight. An ideal weight for a flying disc for throwing by a person is between 150–160 grams. Although discs of this weight are generally preferred for quality of flight, the additional amount of plastic material makes such discs harder and hence more susceptible to cause injuries. Lighter discs are cheaper o make, but suffer from poor flight characteristics.

Disc 10 of the present invention uses layers 28*a* and 28*b* of resilient material to increase the weight of an otherwise relatively light plastic disc 12 to a more desirable weight. By adding the resilient material, which has a lower density than the plastic material of plastic disc 12, the total weight of covered disc 10 can be increased without making the disc harder. The thickness of the layer of resilient material is selected to provide the desired total weight of disc 10 and the desired amount of cushioning.

The thickness of layers 28*a* and 28*b* of resilient material is also selected so as to provide disc 10 with sufficient buoyancy to cause the disc to float in water. Since the resilient material has a lower density than the plastic material of plastic disc 12, increasing the thickness of layers 28*a* and 28*b* decreases the overall density of the covered disc 10. This increases the buoyancy of covered disc 10, thus allowing it to float.

Instead of launching or throwing disc 10 substantially forward and horizontally through the air, a common technique is to throw disc 10 in a forward and downward direction toward a hard surface, such as a concrete pavement. As disc 10 approaches the hard surface, the lower edge 26 of rim 22 contacts the hard surface, and the spin, forward velocity, and downward velocity of disc to cause it to bounce or deflect off the hard surface and continue the flight in an upward and forward direction. For disc 10 to be thrown in such a fashion, it is necessary for the lower edge 26 of rim 22 to slide and bounce off the hard surface. For this to happen, plastic lower edge 26 of plastic disc 12 must be exposed and not covered by the resilient material. If lower edge 26 were covered with resilient material, disc 10 would not properly slide and bounce off the hard surface. Also, if lower edge 26 were covered with resilient material, repeated throwing of disc 10 against a hard surface as described above would cause the layer of resilient material to tear and wear out along the lower edge 26 of rim 22.

The covered flying disc 10 of the present invention provides considerable advantages over the currently available flying discs. The resilient layer that covers disc 10 provides an improved, cushioned grip which facilitates gripping disc 10 and reduces the chance of injury to the user. Furthermore, the resilient layer of disc 10 also allows disc 10 to float. Still further, the resilient layer of disc 10 increases the weight of the disc while providing a cushioned outer layer, thus improving the flight characteristics of disc 10 without increasing its propensity to injure the user. Still further, the grooves formed in the resilient layer of disc 10 help in placing the resilient layer over disc 10 and also improve the flight characteristics of disc 10.

While the invention has been particularly shown and described with reference to a preferred embodiment, it will be understood by those skilled in the art that various changes in form and detail may be made therein without departing from the spirit and scope of the invention.

What is claimed is:

1. An improved flying disc adapted for throwing, the improved disc comprising:

a body;

a peripheral portion for gripping the body with a hand and launching the body through the air;

an upper surface and a lower surface aerodynamically shaped to cause the body to fly when thrown;

a rim extending around the peripheral portion;

a layer of resilient material covering the peripheral portion of at least one of said surfaces of the body, and the rim of the body; and the resilient material having greater resiliency than the body to provide a cushioned grip which facilitates gripping.

2. The flying disc according to claim 1 further comprising grooves formed in the lager of resilient material on at least on of said surfaces.

3. The flying disc according to claim 1 further comprising spiral grooves formed in the layer of resilient material on at least one of said surfaces.

4. The flying disc according to claim 1 wherein the disc is adapted for throwing with a clockwise spin and wherein the disc further comprises counter-clockwise spiral grooves, as seen from above the disc, formed in the layer of resilient material on at least one of said surfaces.

5. The flying disc according to claim 1 further comprising a plurality of grooves formed in the resilient material at selected locations to facilitate the placement of the layer of resilient material on the body.

6. The flying disc according to claim 1 wherein the disc has sufficient buoyancy to float.

7. The flying disc according to claim 1 wherein the resilient material is foam-like material.

8. The flying disc according to claim 1 wherein the rim extends below the lower surface and comprises a sidewall and a lower edge, the disc further comprising:

a layer of resilient material covering the sidewall of the rim of the body; and the lower edge of the rim of the body being free of the resilient material to allow the lower edge of the body to slide along a surface.

9. An improved flying disc adapted to be thrown by gripping a periphery thereof with a hand and launching the disc through the air, the disc having a body with an upper surface, a lower surface, and a rim around the periphery of the body, the rim extending below the lower surface and comprising a sidewall and a lower edge, the improved disc comprising:

a layer of resilient material covering the upper surface, lower surface, and sidewall of the body;

the lower edge of the rim of the body being free of the resilient material to allow the lower edge of the body to slide along a surface;

the resilient material having a greater resiliency than the body to provide a cushioned grip which facilitates gripping the body; and a plurality of grooves formed in the layer of resilient material on at least one of said surfaces.

10. The flying disc according to claim 9 wherein the grooves are spirally oriented.

11. The flying disc according to claim 9 wherein the grooves are formed in the resilient material at selected locations to facilitate the placement of the layer of resilient material on the body.

12. The flying disc according to claim 9 wherein the disc has sufficient buoyancy to float.

13. The flying disc according to claim 9 wherein the disc is adapted for throwing with a clockwise spin and wherein the grooves are oriented in a counter-clockwise spiral fashion, as seen from above the disc.

14. The flying disc according to claim 9 wherein the resilient material is a foam-like material.

15. An improved flying disc adapted for throwing, the improved disc comprising:

a body;

a peripheral portion for gripping the body with a hand and launching the body through the air;

an upper surface and a lower surface aerodynamically shaped to cause the body to fly when thrown;

a rim extending around the peripheral portion;

a layer of resilient material covering the peripheral portion of at least one of said surfaces of the body, and the rim of the body; and the resilient material having a density lower than that of the body to cause the disc to float.

16. The flying disc according to claim 1 further comprising grooves formed in the layer of resilient material on at least on of said surfaces.

17. The flying disc according to claim 1 further comprising spiral grooves formed in the layer of resilient material on at least one of said surfaces.

18. The flying disc according to claim 1 further comprising a plurality of grooves formed in the resilient material at selected locations to facilitate the placement of the layer of resilient material on the body.

19. The flying disc according to claim 1 wherein the resilient material is foam-like material.

20. The flying disc according to claim 1 wherein the rim extends below the lower surface and comprises a sidewall and a lower edge, the disc further comprising:

a layer of resilient material covering the sidewall of the rim of the body; and the lower edge of the rim of the body being free of the resilient material to allow the lower edge of the body to slide along a surface.

* * * * *